US005953039A

United States Patent [19]

Boutet et al.

[11] Patent Number: 5,953,039

[45] Date of Patent: Sep. 14, 1999

[54] PHOTOTHERMOGRAPHIC DRUM PROCESSOR USING LOW HEAT CONDUCTIVITY AND LOW HEAT CAPACITANCE ROLLERS

[75] Inventors: John C. Boutet, Rochester; Jeffrey J. Yaskow, Williamson, both of N.Y.

[73] Assignee: Eastman Kodak Company, Rochester, N.Y.

[21] Appl. No.: 08/977,162

[22] Filed: Nov. 24, 1997

[51] Int. Cl.[6] ..... G03G 15/20

[52] U.S. Cl. ..... 347/204; 347/215; 399/154; 399/328; 399/331; 399/339

[58] Field of Search ..... 347/204, 262, 347/264, 215; 399/328, 322, 330, 331, 332, 339, 154; 428/36.5; 216/6; 242/544

[56] References Cited

U.S. PATENT DOCUMENTS

| | | | |
|---|---|---|---|
| 3,561,133 | 2/1971 | Hauck | 34/110 |
| 4,112,280 | 9/1978 | Salsich et al. | 219/216 |
| 4,533,231 | 8/1985 | Shigenobu | 399/331 |
| 4,653,897 | 3/1987 | Fromm | 399/331 |
| 5,005,778 | 4/1991 | Gladish | 242/544 |
| 5,294,290 | 3/1994 | Reed | 216/6 |
| 5,319,430 | 6/1994 | DeBolt et al. | 399/322 |
| 5,352,863 | 10/1994 | Svendsen | 219/388 |
| 5,493,327 | 2/1996 | McCallum et al. | 347/262 |
| 5,656,344 | 8/1997 | Sawa et al. | 428/36.5 |

FOREIGN PATENT DOCUMENTS

| | | |
|---|---|---|
| 1338102 | 8/1963 | France . |
| 95/30934 | 11/1995 | WIPO . |

OTHER PUBLICATIONS

Research Disclosure 18330, "Means for transporting photothermographic materials," published May 1979, disclosed by F.D. Hauck.

*Primary Examiner*—N. Le
*Assistant Examiner*—Hai C. Pham
*Attorney, Agent, or Firm*—William F. Noval

[57] ABSTRACT

A processor for photothermographic media comprising: a rotatably mounted heated drum; and a plurality of rollers spaced around the periphery of the drum to hold down photothermographic media to the drum over a segment of the circumference thereof, the rollers including an outer layer of low density, low thermal mass, and low thermal conductivity elastomer foam coating which have very little heat contribution to the media to achieve uniform media processing.

3 Claims, 3 Drawing Sheets

PHOTOTHERMOGRAPHIC DRUM PROCESSOR USING LOW HEAT CONDUCTIVITY AND LOW HEAT CAPACITANCE ROLLERS

FIELD OF THE INVENTION

This invention relates in general to photothermographic media processors and relates more particularly to a photothermographic media drum processor using low heat conductivity and low heat capacitance media hold down rollers to achieve uniform thermal processing and to avoid media damage.

BACKGROUND OF THE INVENTION

Conventional medical imaging film is processed using wet chemical processors. Although conventional medical film provides a high quality, high resolution medical image, wet chemical processing in the health care environments, such as hospitals and radiology departments, introduces environmental, storage, disposal and space problems. Recently introduced photothermographic media film eliminates many of these problems. Photothermographic film is processed in a thermal processor that uses heat to develop the film. Thus, chemicals need not be stored or disposed of, saving space, eliminating special plumbing installation, and minimizing environmental problems.

One type of thermal processor uses a heated drum for developing an exposed film brought into contact with the drum. The film can be held in contact with the drum by means of a web or rollers (see: FR Patent 1,338,102, granted Aug. 12, 1963, applicant Societe d'Etudes et de Recherches Diazo; PCT unexamined International Application WO 95/30934, published Nov. 16, 1995, inventors Star et al; U.S. Pat. No. 3,561,133, issued Feb. 9, 1971, inventor Hauck; U.S. Pat. No. 4,112,280, issued Sep. 5, 1978, inventors Salsich et al.). Research Disclosure 18330, published May 1979, disclosed by F. D. Hauck, discloses a processor for processing photothermographic film or paper including a plurality of ultrasoft, yarn-covered rollers. U.S. Pat. No. 5,352,863 discloses a flat bed thermophotographic film processor including a bed of spaced rollers of low thermal conductivity foam material. There is no disclosure in this patent of using these rollers as hold-down rollers in a heated drum processor.

Although these processors may be suitable for the applications for which they were intended, there exists a need for a heated drum processor for photothermographic media having improved in sheet and sheet-to-sheet media processing uniformity.

SUMMARY OF THE INVENTION

According to the present invention, there is provided a solution to the problems of the prior art.

According to a feature of the present invention, there is provided a processor for photothermographic media comprising: a rotatably mounted heated drum; and a plurality of rollers spaced around the periphery of the drum to hold down photothermographic media to the drum over a segment of the circumference thereof, the rollers including an outer layer of low density, low thermal mass, and low thermal conductivity elastomer foam coating which have very little heat contribution to the media to achieve uniform media processing.

ADVANTAGEOUS EFFECT OF THE INVENTION

The invention has the following advantages.

1. A photothermographic sheet drum processor has improved in sheet and sheet-to-sheet processing uniformity.

2. The processor is thermally efficient, cost effective and simple in construction.

DETAILED DESCRIPTION OF THE INVENTION

Figure 1:
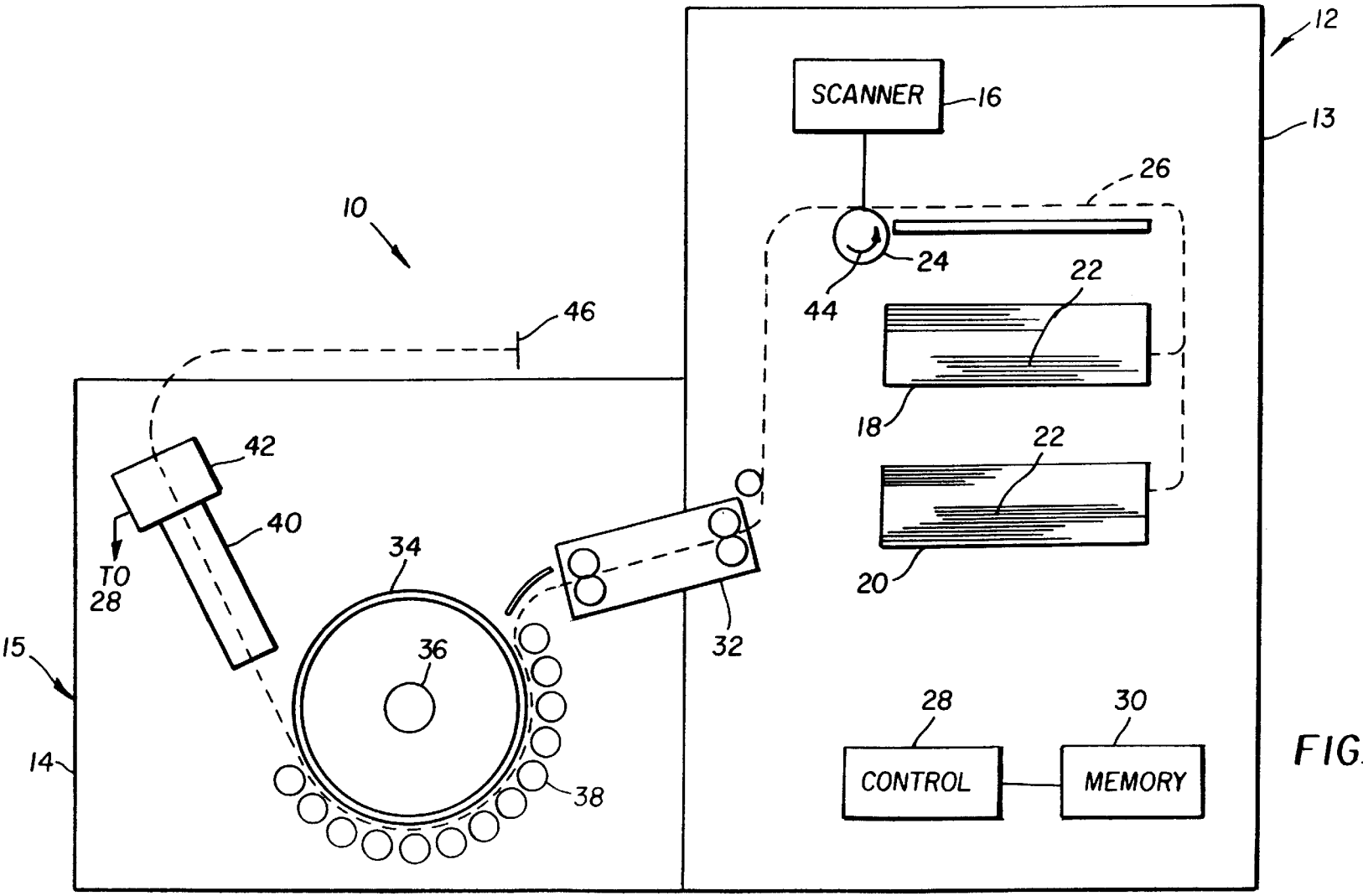
FIG. 1 is a diagrammatic view of laser imaging apparatus incorporating the present invention.

Referring now to FIG. 1, there is shown laser imaging apparatus incorporating the present invention. As shown, apparatus 10 includes a laser printer 12 and processor 14. Although printer 12 and processor 14 are shown as housed in separate units, it will be understood that they could be integrated into one housing. In the specific application described here, printer 12 is a medical image laser printer for printing medical images on photothermographic film which is thermally processed by thermal processor 14. The medical images printed by printer 12 can be derived from medical image sources, such as medical image diagnostic scanners (MRI, CT, US, PET), direct digital radiography, computed radiography, digitized medical image media (film, paper), and archived medical images.

Printer 12 includes printer housing 13, laser scanner 16, supplies 18,20 for unexposed photothermographic film 22, a slow scan drum 24, film path 26, control 28, memory 30, printer/processor film interface 32. Processor 14 includes processor housing 15, interface 32, drum 34 heated by lamp 36, hold-down rollers 38 located around a segment of the periphery of drum 34, exposed film cooling assembly 40, densitometer 42, and output tray 46.

Apparatus 10 operates in general as follows. A medical image stored in memory 30 modulates the laser beam produced by the laser of scanner 16. The modulated laser beam is repetitively scanned in a fast or line scan direction to expose photothermographic film 22. Film 22 is moved in a slow or page scan direction by slow scan drum 24 which rotates in the direction of arrow 44. Unexposed photothermographic film 22, located in supplies 18,20, is moved along film path 26 to slow scan drum 24. A medical image is raster scanned onto film 22 through the cooperative operation of scanner 16 and drum 24.

After film 22 has been exposed, it is transported along path 26 to processor 14 by printer/processor film interface 32. The exposed film 22 is developed by passing it over heated drum 34 to which it is held by rollers 38. After development, the film 22 is cooled in film cooling assembly 40. Densitometer 42 reads the density of control patches at the front edge of film 22 to maintain calibration of the laser imaging apparatus 10. The cooled film 22 is output to tray 46 where it can be removed by a user.

According to the present invention, in-sheet and sheet-to-sheet uniformity is achieved by using low thermal mass and low thermal conductivity rollers 38 which have very little heat contribution to the film. If the rollers heat contribution to the film during the film heating phase of processing is kept small, temperature change of these rollers during film processing has little effect on the processing density achieved.

A low density resilient elastomer foam can provide these properties. A high air to elastomer ratio keeps the thermal mass and conductivity of the rollers low.

The rollers 38 must provide enough pressure to the surface of the film being processed on the drum 34 to suppress dirt artifacts by pressing the dirt trapped between the film and drum into the silicone (elastomer) coating on the drum 34. This avoids air pockets around the dirt and the resulting "tent pole" artifacts they cause.

To keep the pressure roller assembly cost low, it is desirable to have a resilient compressible foam on the roller 38 surface so that the rollers 38 do not have to be spring mounted to provide uniform pressure while accommodating assembly tolerances.

Since, in the ideal case of the low thermal mass pressure roller processor design, all the heat supplied to the film 22 comes from the heat drum 34, it is desirable to have the compliant pressure roller surface provide a long duration nip which lengthens the intimate contact time the film is pressed against the heat source.

Figure 2:
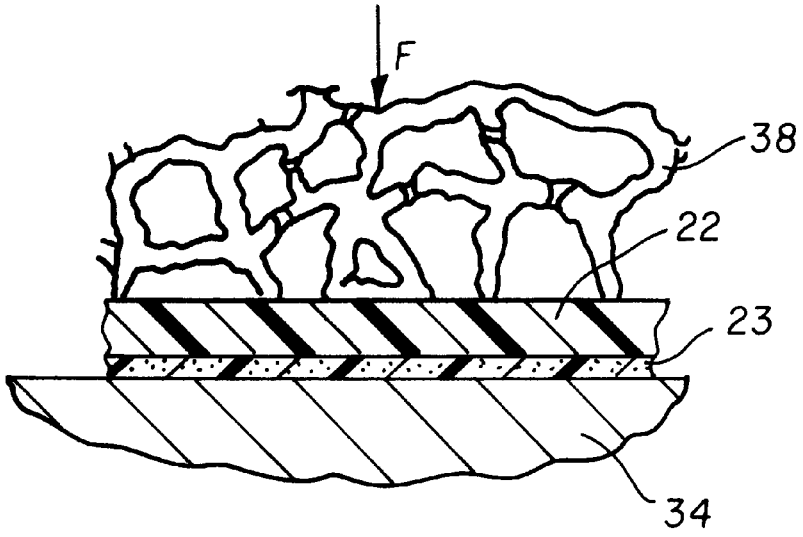
FIGS. 2 and 3 are diagrammatic sectional views useful in illustrating the present invention.
Figure 3:
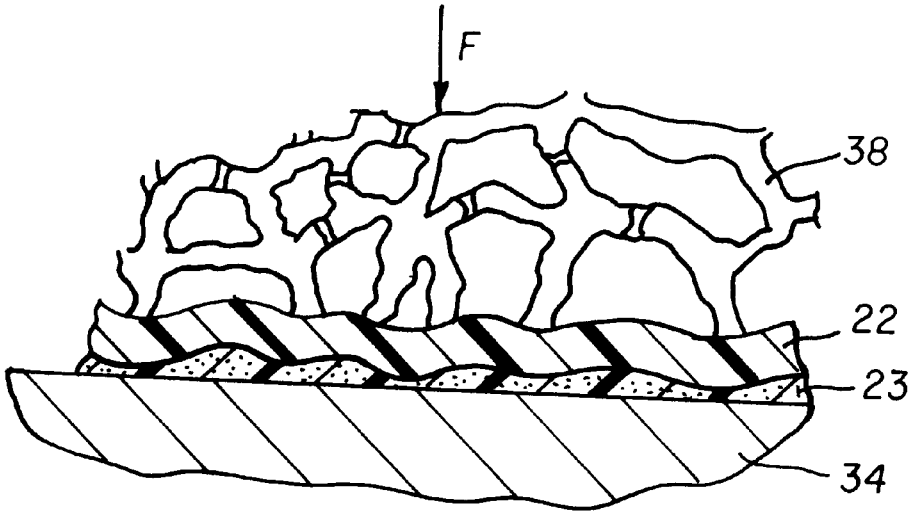

To provide uniform processing, it is desirable that the foam roller have a foam cell size which is small, preferably in the range of the film base thickness. This ensures that the "beam strength" of the base distributes the pressure peaks at the cell walls. If the cell size is too big, the pressure at the contact point causes the softened emulsion 23 to flow sideways yielding a small scale density non-uniformity (FIGS. 2 and 3).

To minimize thermal mass in the foam, the cell walls must be thin. The thinner the cell walls are, the stiffer the cell was material must be to maintain the same foam stiffness. Good resilience is required for springback.

Because the foam on the rollers 38 must undergo a large temperature rise from startup to operating temperature, it is best to use an open cell foam to minimize roller expansion during heatup (gas expansion with temperature causes closed cell foams to expand more than open cell foams).

It is desirable that the roller 38 material be electrically conductive and that rollers 38 be electrically grounded to minimize static buildup. If the elastomer itself cannot be made conductive, the foam made from the elastomer can be impregnated with a conductive material which coats the sides of the cellular walls. It is also desirable that the foam, drum surface elastomer, and film triboelectric properties be balanced to minimize static generation.

The effective drive velocity of the nip formed by the elastomer coated drum 34 and the pressure roller 38 varies as a function of the pressure. If the pressure roller does not bow as a result of the nip pressure, the pressure can be constant across the width of the nip and the surface velocities of drum surface in the nip are equal and constant across the width of the drum. If the pressure roller bows, the nip drives the film faster in the area of higher pressure where drum elastomer is most deformed. For example, using steel pressure rollers on an elastomer coated drum, the rollers bow and deform the drum elastomer more on the sides than in the middle of the drum. The drum tries to drive the film faster on the sides than in the middle. The pressure rollers drive the film at equal speed across its width. The film base resists distortion. The net effect is a shear stress in the emulsion which causes a density nonuniformity in the processed emulsion.

Figure 5:
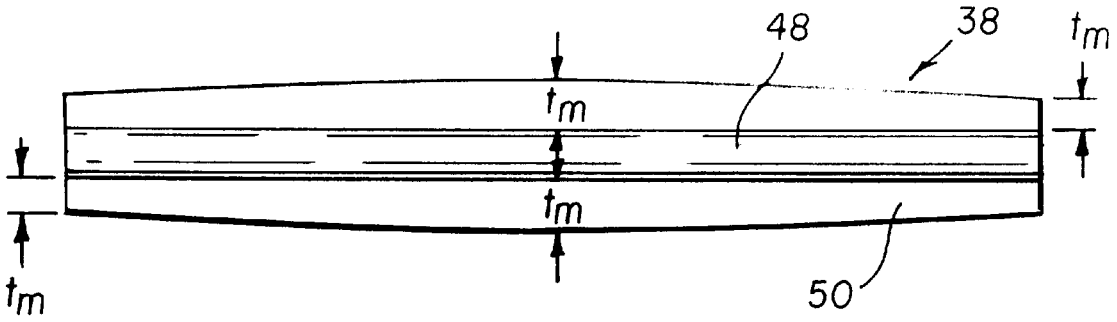
FIG. 5 is another embodiment of the present invention.

To achieve even pressure on the drum across the width of the film, the foam roller can be ground with a crown. If, for instance, the desired even pressure will cause a 0.15" deflection in the center of the bowed shaft, grinding the foam so the thickness $t_m$ is 0.15" greater in the center than at the ends, t, will provide an even pressure across the roller when it is loaded to the designed load. FIG. 5 shows roller 38 with shaft 48 and crowned foamed layer 50.

The thicker and more compliant the foam coating on the pressure roller is, the less sensitive the design will be to pressure roller bearing position tolerance.

Figure 4:
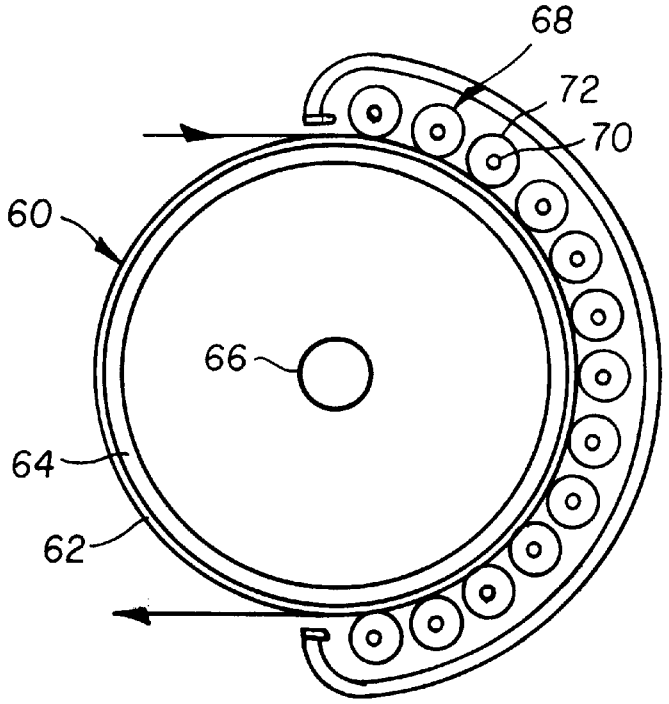
FIG. 4 is a diagrammatic view of an embodiment of the present invention.

Given these many design considerations, a preferred embodiment of the low heat transfer pressure roller design of the present invention is as follows and is shown in FIG. 4.

1. A drum 60 with a thin heat transferring elastomer coating 62 ≈0.030" thick on an aluminum base 64. The drum is heated by an internal heat source 66 to a constant processing temperature.

2. Low heat transfer (low thermal mass and low conductivity) pressure rollers 68 having shafts 70 and low thermal conductivity foamed elastomer coating 72.

3. For a 17" wide drum, the pressure roller shafts 70 should be ⅜" to ½" diameter for adequate stiffness.

4. The foam coating 72 has a cell size of less than 0.020" diameter, is uniform density, has good compliance and resiliency, is open celled, is electrically conductive, is resistant to heat of at least 180° C. for short exposure and 130° C. continuous use and is preferably at least ⅛" thick. The foam must be resistant to cyclic strain fatigue. A carbon black impregnated or otherwise made conductive silicone foam is a preferable material.

5. The pressure roller shaft bearing are mounted in fixed mounts (not shown) and the foam compliance is relied on for uniform pressure sufficient to suppress tent pole artifacts and provide good drum contact for heating the film. (For foam thicknesses less than ⅛", spring loaded rollers are preferred.)

6. The ground foam rollers 68 have a crowned profile (FIG. 5) approximately equal to the bow the shaft experiences under operating conditions (at processing temperature).

7. The roller assembly is enclosed in an insulating enclosure 72 (FIG. 5) to keep the roller and air temperature near the drum temperature.

Although specific materials have been described above it will be understood that other materials can be used in the present invention. Thus, polyurethane or other type of low heat capacitance and transfer foam can be used for rollers 38.

Although the present invention has been described with reference to preferred embodiments, those skilled in the art will recognize that changes can be made in form and detail without departing from the spirit and scope of the invention.

PARTS LIST

10 apparatus
12 laser printer
13 printer housing
14 processor
15 processor housing
16 laser scanner
18,20 supplies

22 photothermographic film
23 softened emulsion
24 slow scan drum
26 film path
28 control
30 memory
32 printer/processor film interface
34 drum
36 lamp
38 hold-down rollers
40 film cooling assembly
42 densitometer
44 directional arrow
46 output tray
48 shaft
50 crowned foamed layer
60 drum
62 elastomer coating
64 aluminum base
66 internal heat source
68 pressure rollers
70 shafts
72 foam coating

What is claimed is:

1. A processor for photothermographic media comprising:

a rotatably mounted heated drum; and a plurality of rollers spaced around the periphery of said drum to hold down photothermographic media to said drum over a segment of the circumference thereof, said rollers including an outer layer in direct contact with photothermographic media and of low density, low thermal mass, and low thermal conductivity elastomer foam coating which has very little heat contribution to the media to achieve uniform media processing wherein said foam coating has a foam cell size of less than 0.020", diameter, is uniform in density, has good compliance and resilience, is electrically conductive, is triboelectrically balanced to the media and drum surface properties to minimize static, is resistant to heat of at least 180° C. for short exposure and 130° C. for continuous use, is at least ⅛" thick, and is resistant to cyclic strain fatigue.

2. The processor of claim 1 wherein each said roller has a cylindrical shaft and wherein said foam coating surrounds said cylindrical shaft and is crowned having a thickness greater in the middle than at the edges and wherein said shaft experiences a bow during operating conditions and said crowned coating has a profile approximately equal to said bow.

3. The processor of claim 1 including a laser printer operatively associated with said processor for producing imagewise exposed photothermographic media to be processed by said processor.

* * * * *